US010258865B1

(12) United States Patent
Frederick

(10) Patent No.: US 10,258,865 B1
(45) Date of Patent: Apr. 16, 2019

(54) ATHLETIC FIELD BOUNDARY SYSTEM

(71) Applicant: John Frederick, Nacogdoches, TX (US)

(72) Inventor: John Frederick, Nacogdoches, TX (US)

( * ) Notice: Subject to any disclaimer, the term of this patent is extended or adjusted under 35 U.S.C. 154(b) by 659 days.

(21) Appl. No.: 14/514,224

(22) Filed: Oct. 14, 2014

(51) Int. Cl.
*A63C 19/06* (2006.01)
*G09F 19/22* (2006.01)

(52) U.S. Cl.
CPC ..... *A63C 19/065* (2013.01); *G09F 19/228* (2013.01)

(58) Field of Classification Search
CPC ..... A63C 19/00; A63C 19/06; A63C 19/065; G09F 19/228
See application file for complete search history.

(56) References Cited

U.S. PATENT DOCUMENTS 1,193,571 A * 8/1916 Lord ..... A63B 61/00 473/490
1,986,941 A * 1/1935 Pearson ..... A63C 19/065 473/490
3,039,197 A * 6/1962 Abbott ..... A63C 19/065 33/456
3,896,248 A * 7/1975 Scarpa ..... A63C 19/065 118/118
3,985,359 A * 10/1976 Moore ..... A63C 19/08 242/118.41
4,202,543 A * 5/1980 Collins ..... A63C 19/00 273/359
5,613,855 A * 3/1997 Thompson ..... A63C 19/06 434/242
5,741,194 A * 4/1998 Simunek ..... A63C 19/00 473/490
5,839,903 A * 11/1998 Thompson ..... A63C 19/065 434/247
6,120,395 A * 9/2000 Dorenbusch ..... A63C 19/06 473/465
2009/0030791 A1* 1/2009 Chitturi ..... G06Q 30/02 705/14.16
2010/0317466 A1* 12/2010 Semple ..... A63B 61/003 473/467
2013/0120715 A1* 5/2013 Ueda ..... A63C 19/065 353/30
2015/0148154 A1* 5/2015 McRoskey ..... A63C 19/065 473/490

* cited by examiner

*Primary Examiner* — Raleigh W Chiu
(74) *Attorney, Agent, or Firm* — Eldredge Law Firm, LLC; Richard Eldredge; Beth Felix

(57) ABSTRACT

A field demarcation boundary line system includes a first boundary strip sufficiently durable to withstand tearing due to stepping thereon. The first boundary strip includes a width, a top surface area, and an advertisement on the top surface area. The system further includes a fastening device configured to secure the first boundary strip to the ground. The method includes displaying the advertisement on the top surface of the first strip for viewing access to the spectator.

7 Claims, 9 Drawing Sheets

ATHLETIC FIELD BOUNDARY SYSTEM

BACKGROUND

1. Field of the Invention

The present invention relates in general to athletic field boundaries, and in particular to a method of defining and quickly establishing temporary boundaries for the playing field of the sport being practiced or played.

2. Description of Related Art

Traditional sports such as baseball, football, flag football, soccer, rugby, field hockey, ultimate Frisbee, lacrosse, and the like continue to grow in popularity. In FIG. 1, a top view of conventional soccer playing field 101 is provided. The field 101 includes a plurality of demarcation lines 103 that in turn define the outer boundaries of the field along with important infield boundary lines.

It should be understood that the availability of suitable areas for practice and competition for the various activities presents a known problem. Coaches and organizers for participants, from youth soccer teams to adult rugby, generally locate in grassy areas such as parks, school yards, and the like to play such sporting activities. The players will generally define the playing field boundaries with makeshift objects such as clothing, gym bags, cones, and the like. Conventional means of more permanently marking playing fields include chalk, paint or trenching to remove grass along the sidelines and end lines to define the playing field, as depicted in FIG. 1.

Although great strides have been made in the field to demarking boundary lines for sporting events, many shortcomings remain.

SUMMARY

Accordingly, it is the principal object of this invention to provide a simple, economical, portable means of establishing a boundary of proper size for playing fields of field sports such as football, flag football, soccer, rugby, field hockey, ultimate Frisbee, baseball, softball, wiffle ball, lacrosse, and the other playing fields with said demarcations being appropriate for the given sport.

The method and apparatus of the present invention could include a flexible, singular cord, tape, rope, string, twine, braided cloth or other material of appropriate length that is affixed the ground and outlines the entire perimeter or a boundary line of a sports field for the practice or competition of field sports such as football, flag football, soccer, rugby, field hockey, lacrosse, ultimate frisbee and other field sports that are played on playing fields.

In one exemplary embodiment of the present application, establishing said boundaries could be accomplished by staking or otherwise affixing multiple attachment points with the demarcation lines to the ground.

In another contemplated embodiment, the present application is directed to effective means for advertising, therein the advertisement is positioned on the cord, strap, and other device used to establish the playing boundaries.

In yet another contemplated embodiment, an additional demarcation line could be used to keep the spectators at a distance relative to the boundary demarcation lines.

In yet another embodiment, it is contemplated using the features of the systems discussed herein for use with walking and/or spectator paths.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
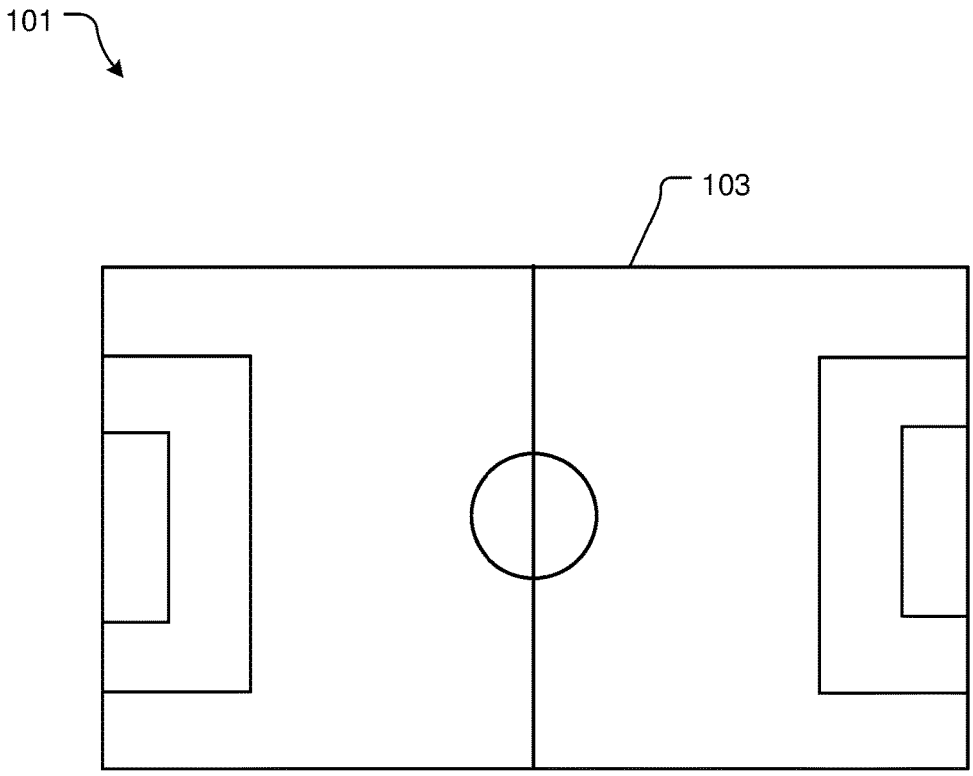
FIG. 1 (Prior Art)
FIG. 1 is a simplified top view of a conventional soccer field with painted demarcation boundary lines.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional athletic field boundaries. Specifically, the system of the present application is configured to provide rapid and effective means to transport and setup an athletic field boundary area to the ground area, thus providing an instant playing field. The system also provides for an effective means to advertise to spectators and the team athletes during use. The system provides with an outer perimeter boundary line configured to keep the spectators at a distance relative to the field boundary lines. The features discussed herein could also be used as demarcation lines for walking paths or the like. Lastly, the system includes one or more anchoring systems and adjustment devices to affix the boundary line strip to the ground surface. The anchoring device could include a body with spike attached thereto, wherein the body is configured to affix the boundary line strip to the ground surface by means of the user stepping on the body. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 2:
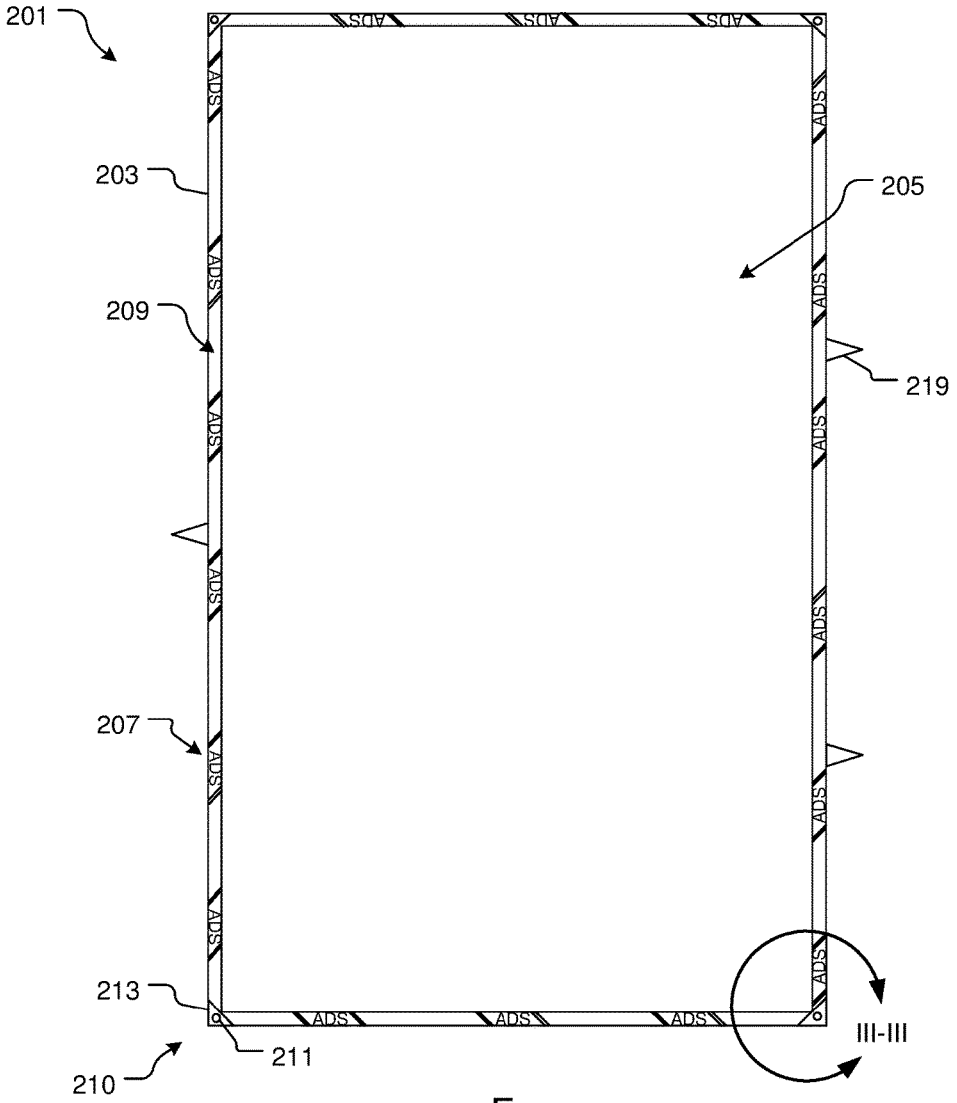
FIG. 2 is a simplified top view of an athletic field boundary system in accordance with a preferred embodiment of the present application.
Figure 3:
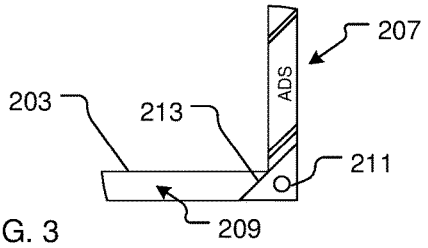
FIG. 3 is an enlarged top view of the system of FIG. 2 taken at III-III.

Referring now to the drawings wherein like reference characters identify corresponding or similar elements throughout the several views, FIGS. 2 and 3 depict a simplified top view of the field boundary system 201 in accordance with a preferred embodiment of the present application. It will be appreciated that the system 201 overcomes one of more of the above-listed problems commonly associated with the conventional field boundary systems.

To achieve the desired objectives of portability and economical construction, the preferred embodiment of system 201 includes one or more of a field boundary strip 203 composed of, for example, a plastic, nylon, composite, cloth and/or other suitable material configured to resist rip from the player stepping thereon and long exposure to the elements.

As depicted, the strip 203 is used as a demarcation of a playing area 205. In one embodiment, the strip 203 could be used for a soccer playing field; however, it should be understood that the demarcation lines could be used on other types of playing fields, in particular, a wiffle ball, baseball, softball, or kickball field forming a V-shaped configuration in lieu of the exemplary four-sided boundary area illustrated embodiment.

One of the unique features believed characteristic of the present application is the use of advertisements or messages 207 displayed directly on a surface of strip 203. For example, a beverage company may wish to place a logo or advertisement on strip 203 for viewing access to the players and/or spectators. To achieve this feature, strip 203 has a width that forms a top surface 209 for placement of the advertisement thereon. It should be appreciated that the advertisement marking is sufficiently durable to withstanding players stepping thereon and/or long exposure to the outside elements.

It will be appreciated that the advertisements 207 could be fixedly or removably attached to the top surface of the strips. For example, after a game, the advertisement can be removed prior to the strip being stored. Thus, this feature allows the owner of the boundary strip to choose between advertisements.

Another unique feature believed characteristic of the present application is the ability to easily and rapidly roll strip 203, along with the advertisements thereon, onto a spool or similar means (not shown) for storage and transport. In yet another embodiment, the system could include an anchoring device such as sandbags, weights, or the like that could be used to secure the strap directly to surfaces such as parking lots, gym floors, artificial turf or the like. These features are depicted in FIGS. 6-11 in the drawings and discussed below.

To use the desired invention, the applicant would select an area of sufficient size and, using simple metal stakes, anchoring systems, and/or similar fastening means, would begin application of the field boundary by anchoring one end of the strip to the ground with a stake via a corner device 210 having a hole 211 surrounded by extra durable material 213 to prevent ripping.

The applicant would then proceed to lay out the additional boundary strip until an appropriate second corner is reached. The applicant would then pull taunt the boundary strip material to take up any slack, affixing the strip material to the ground in a straight line. The process is repeated until the playing area 205 is fully enclosed. The boundary strip remains affixed along the ground with the stake, anchoring system, and/or other similar fastening means. With use of a stake, the stake is inserted fully into the ground so that any obstruction or hazard to a participant is minimized.

Figure 4:
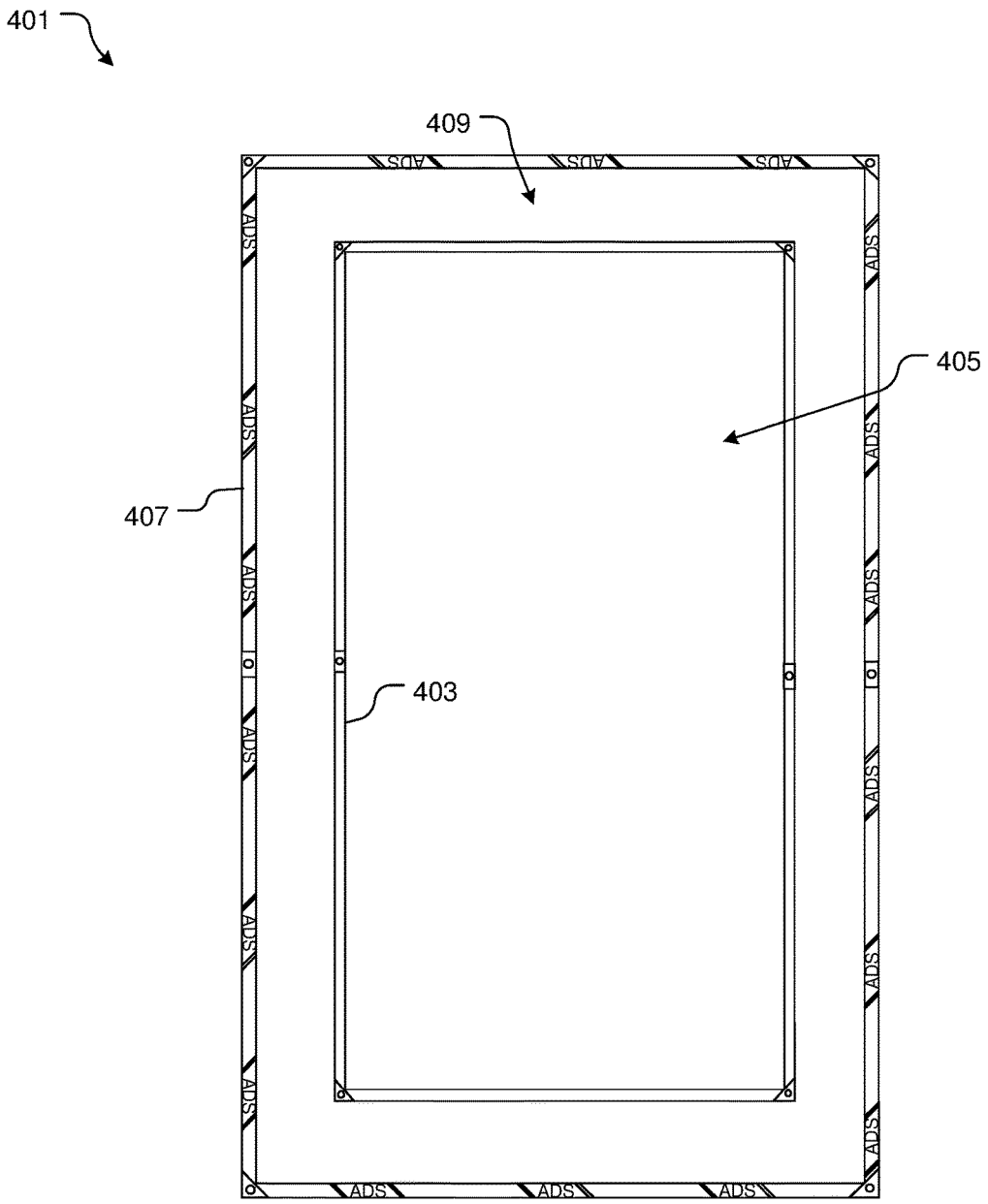
FIG. 4 is a simplified top view of an athletic field boundary system in accordance with an alternative embodiment of the present application.

Referring now to FIG. 4 in the drawings, an alternative embodiment of system 201 is shown. It will be appreciated that system 401 is substantially similar in form and function to system 201 and incorporates one or more of the features discussed herein, and vice-versa.

In the alternative embodiment, system 401 includes an inner boundary strip 403 configured to peripherally surround a playing area 405 therein. One of the unique features believed characteristic of system 401 is the use of an outer boundary strip 407 that, in the exemplary embodiment, periphery surrounds the inner boundary strip 403. As depicted, the two boundary demarcation strips create a gap 409 therebetween, which in turn keeps the spectators at a distance relative to the playing field 405. This feature prevents the spectators from coming into contact with the players during the game. It will be appreciated that the features of system 401 could incorporate an outer boundary strip 407 that does not peripherally surround the inner area 405. For example, the strip 407 could comprise of a simple linear strip that runs alongside one side of the field.

Figure 5:
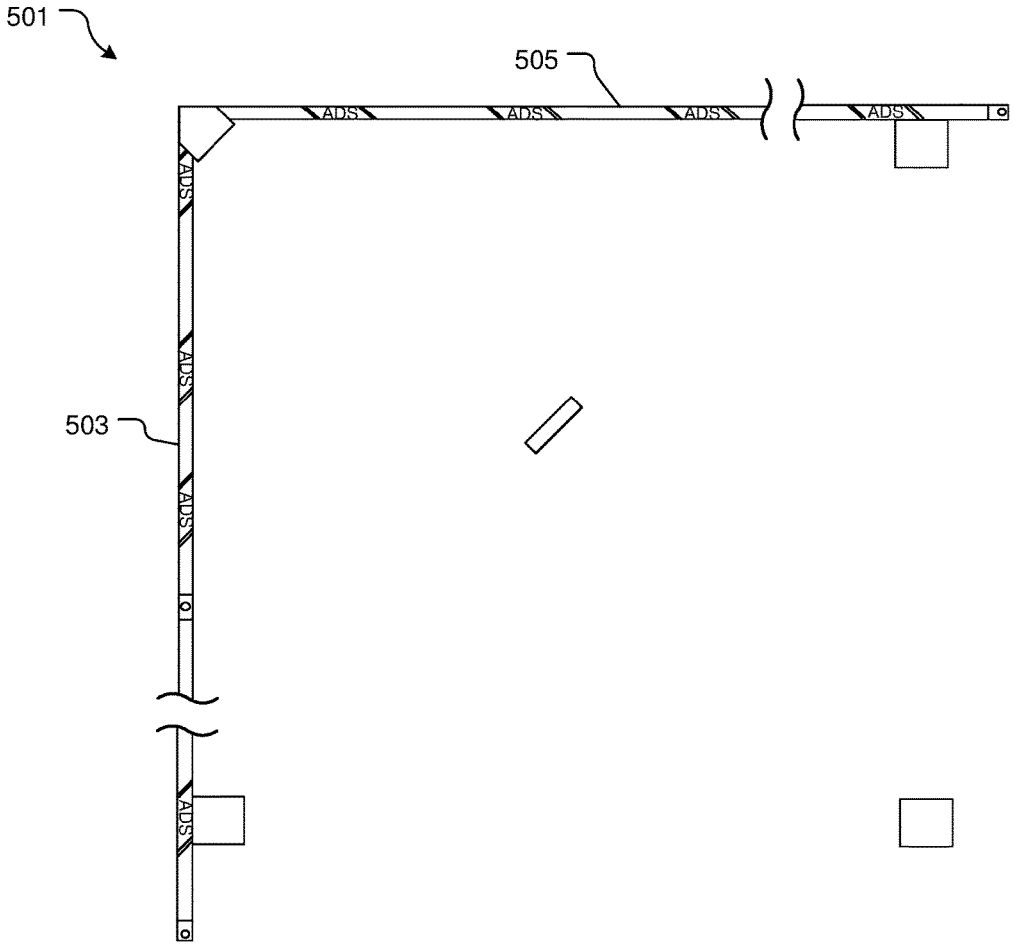
FIG. 5 is a simplified top view of an athletic field boundary system in accordance with an alternative embodiment of the present application.

Referring now to FIG. 5 in the drawings, a simplified top view of a system 501 is shown in accordance with an alternative embodiment of the present application. It will be appreciated that system 501 is substantially similar in function to the systems discussed above and hereby incorporates one or more of the features discussed herein.

In the contemplated embodiment, system 501 includes two strips 503, 505 that join together and form a V-shaped configuration, thus creating a playing field area for baseball, softball, kickball, wiffle ball, and the like similar sports.

Figure 6B:
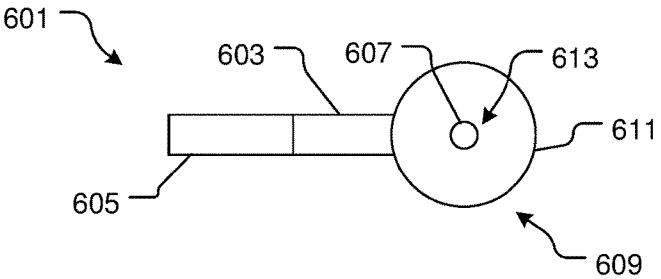
FIGS. 6A and 6B are top views of field strip anchoring system in accordance with a preferred embodiment.
Figure 6A:
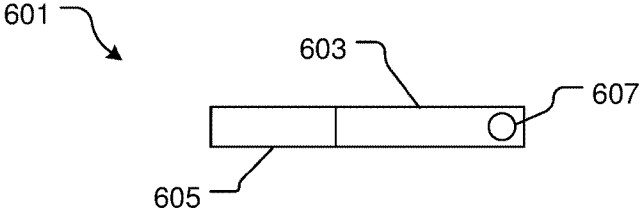

It will be appreciated that another unique feature believed characteristic of the present application is the use of an anchoring system configured to affix the boundary strip in a stationary position on the ground surface. To achieve this feature, it is contemplated using an anchor system 601, as depicted in FIGS. 6A-7B. In FIGS. 6A and 6B, top views of anchor system 601 are shown. The anchor system 601 preferably includes one or more of an elongated body 603 having a section 605 that overlaps a portion of the body and a rod 607 that rigidly attaches to and protrudes from body 603.

Figure 7B:
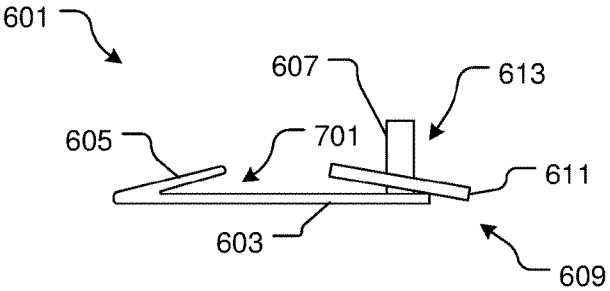
FIGS. 7A and 7B are side views of the anchoring system of respective FIGS. 6A and 6B.
Figure 7A:
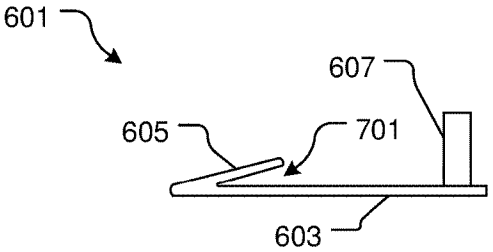

As depicted in FIG. 6B, system 601 is further provided with a weight 609 having a body 611 and an opening 613 configured to receive rod 607. The weight is sufficiently heavy to retain the strip in location during use. As depicted in FIGS. 7A and 7B, side views of system 601 show section 605 forming a gap 701, which in turn receives the boundary layer strip therein. Thus, in the contemplated embodiment, the anchor system 601 receives the boundary strip within gap 701 and retains the strip in position via a weight 609.

Figure 8A:
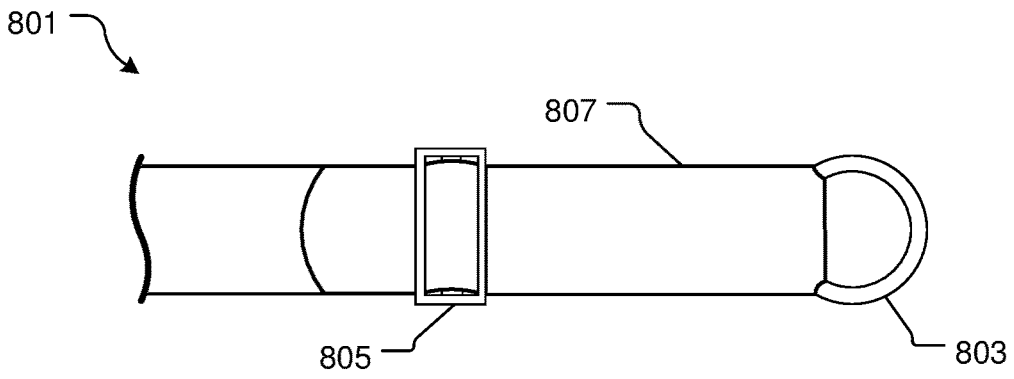
FIGS. 8A and 8B are top views of a field strip adjustable device in accordance with a preferred embodiment.
Figure 8B:
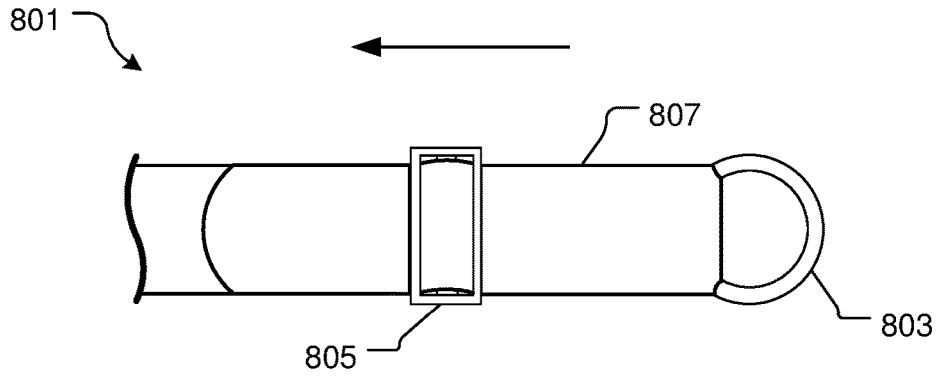

Another unique feature believed characteristic of the present application is the use of an adjustment device 801 configured to adjust the overall length of strip 807. To achieve this feature, device 801 includes a loop 803 configured to receive a stake, anchor, or other suitable means for securing the strip 807 to the ground surface. A slide 805 is used to adjust the length of the strip, as indicated in FIG. 8A.

Figure 9:
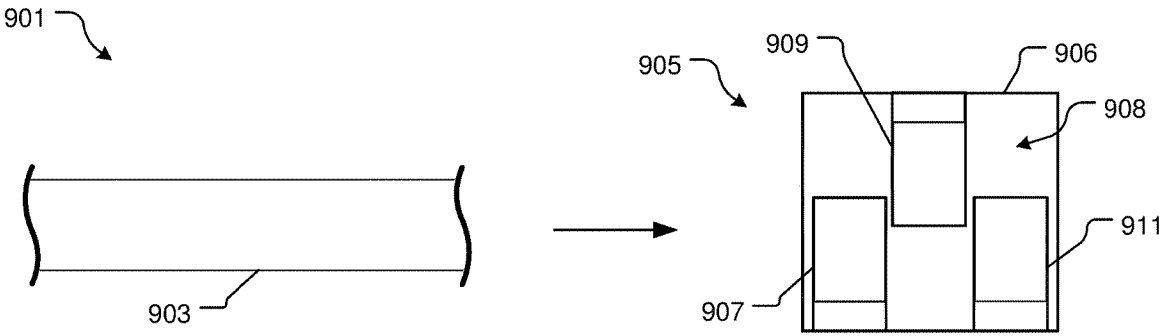
FIGS. 9 and 10 are top views of a field strip anchoring system in accordance with an alternative embodiment.
Figure 10:
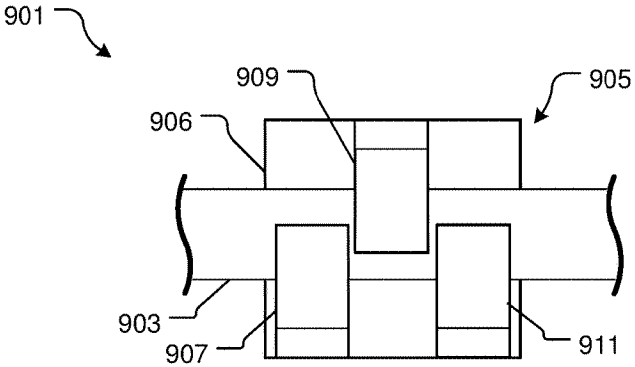
Figure 11:
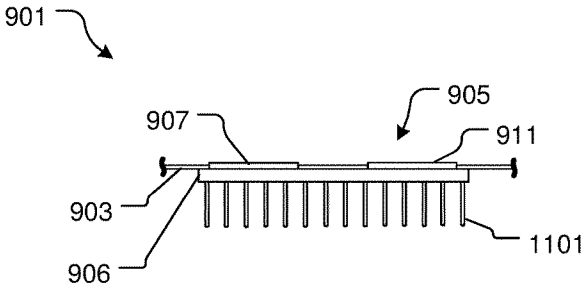
FIG. 11 is a side view of the field strip anchoring system of FIG. 10.

In FIGS. 9-11 of the drawings, an anchoring system 901 is shown. In the contemplated embodiment, system 901 includes an anchor 905 configured to securely attach to a strip 903. More specifically, anchor 905 includes a body 906 with a plurality of flaps or clips 907, 909, and 911 configured to removably rest on a top surface 908 of body 906. As depicted in FIG. 10, the flaps fold over the strip, thereby sandwiching the strip 903 between the top surface 908 and the flaps or clips.

As depicted in FIG. 11, system 901 is further provided with a plurality of teeth or spikes 1101 extending from a surface opposite to surface 908. The teeth are configured to engage with the ground surface area, which in turn retains the anchor 905 in a fixed position relative to the ground.

During use, the user will place the strip 903 on surface 908 and under the flaps. Thereafter, the flaps are folded on the strip and the spikes are pressed into the ground surface, e.g., via pressing down with the foot.

Figure 12:
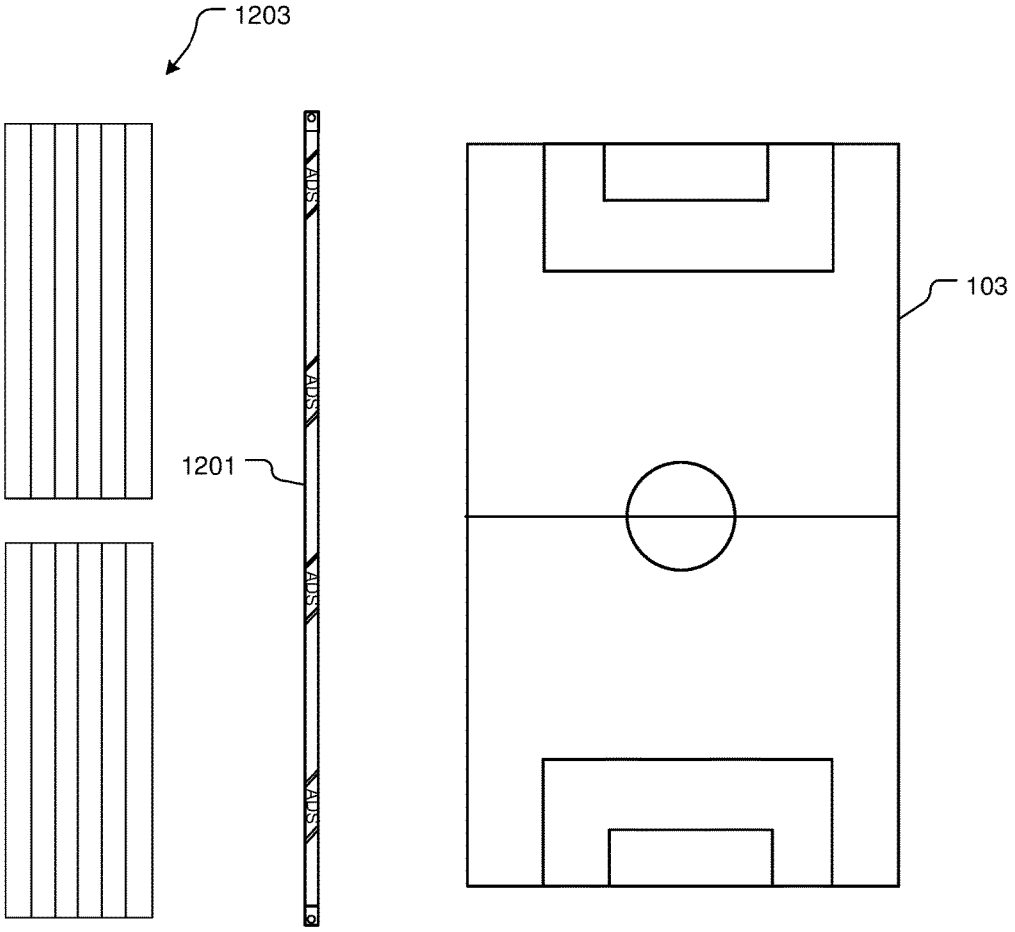
FIG. 12 is a simplified top view of the field strip of FIG. 5.

Referring now to FIG. 12, a strip 1201 is used in accordance with one or more discussed embodiments above. In this embodiment, it is contemplated using the features of the strip 1201 as a means to create a boundary line for spectators (not shown) sitting in seating 1203. Thus, the strip 1201 is effective means to keep the spectators at a predetermined distance from the playing field 103.

Figure 13:
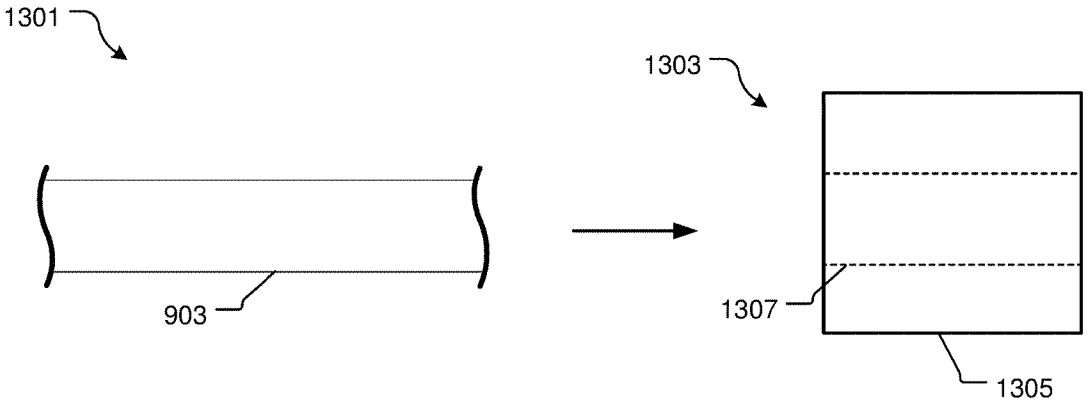
FIGS. 13 and 14 are top views of a field strip anchoring system in accordance with an alternative embodiment.
Figure 14:
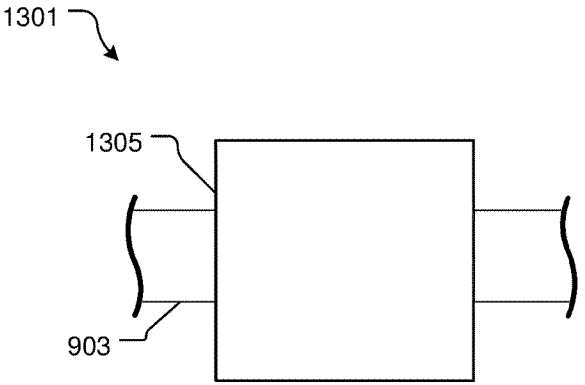
Figure 15:
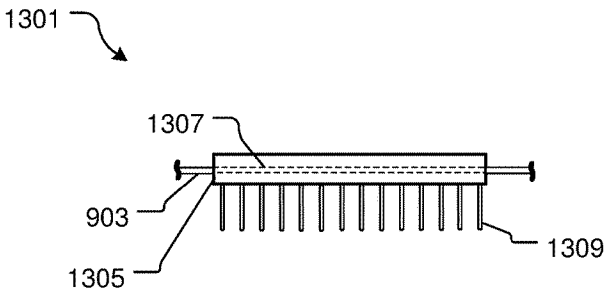
FIG. 15 is a side view of the field strip anchoring system of FIG. 13.

In FIGS. 13-15 of the drawings, an anchoring system 1301 is shown. In the contemplated embodiment, system 1301 includes an anchor 1303 configured to secure the strip 903 to the ground surface (not shown). In the contemplated embodiment, anchor 1303 includes a body 1305 with a channel 1307 extending the length of the body and configured to receive the strip 903 therethrough, as depicted in FIG. 14. Like the anchoring system 901, it is also contemplated using a plurality of teeth 1309, spikes, and the like to secure the body 1305 to the ground surface.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A field demarcation boundary line system, comprising:
a first boundary strip sufficiently durable to withstand tearing due to stepping thereon; and
a second outer boundary strip configured to peripherally surround the first boundary strip;
an adjustment device operably associated with the first boundary strip, the adjustment device, having:
a loop; and
a slide;
wherein the loop is configured engage with an anchor system; and
wherein the slide is configured to releasably engage with the first boundary strip;
wherein a gap is formed between the second outer boundary strip and the first boundary strip;
wherein the second outer boundary strip is configured to keep a spectator at a distance relative to the first boundary area; and
wherein the first boundary strip is configured to create a fully enclosed, predefined field boundary area.

2. The system of claim 1, the second outer strip comprising:
a width;
a top surface area; and
a printed element on the top surface area, the printed element being one or more of an advertisement, a demarcation element, instructions, configuration options, and alignment marks.

3. The system of claim 1, further comprising:
an anchor system configured to engage with and secure the first boundary strip to a ground surface.

4. The system of claim 3, the anchor system, comprising:
a body;
a plurality of flaps secured to the body and configured to engage with the first boundary strip;
wherein the anchor system secures the first boundary strip to a ground surface.

5. The system of claim 4, the anchor system further comprising:
a plurality of spikes extending from the body and configured to penetrate the ground surface.

6. The system of claim 3, the anchor system, comprising:
an elongated body;
a rod rigidly attached to the body and extending therefrom;
a gap formed by an end section and configured to receive the first boundary strip; and
a weight configured to engage with the rod;
wherein the weight is configured to secure the first boundary strip to the ground via the gap.

7. The system of claim 3, the anchor system, comprising:
a body;
a channel disposed within the body and configured to receive the first boundary strip therethrough;
wherein the anchor system secures the first boundary strip to a ground surface.

* * * * *